US008426716B2

(12) United States Patent
Little et al.

(10) Patent No.: US 8,426,716 B2
(45) Date of Patent: Apr. 23, 2013

(54) INTELLIGENT KEYBOARD INTERFACE FOR VIRTUAL MUSICAL INSTRUMENT

(75) Inventors: Alexander Harry Little, Woodside, CA (US); Eli T. Manjarrez, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 1 day.

(21) Appl. No.: 12/986,998

(22) Filed: Jan. 7, 2011

(65) Prior Publication Data

US 2012/0174735 A1 Jul. 12, 2012

(51) Int. Cl.
*G10H 1/38* (2006.01)

(52) U.S. Cl.
USPC ..... 84/613; 84/609; 84/615; 84/637; 84/645; 84/649; 84/650; 84/653; 84/669; 84/610

(58) Field of Classification Search ..... 84/423 R, 84/613, 615, 637, 645, 650, 669, 715, 317, 84/443, DIG. 22, 743, 744, 745
See application file for complete search history.

(56) References Cited

U.S. PATENT DOCUMENTS

| | | | | |
|---|---|---|---|---|
| 5,088,378 | A | 2/1992 | DeLaTorre | |
| 5,425,297 | A * | 6/1995 | Young, Jr. | 84/483.2 |
| 5,440,071 | A * | 8/1995 | Johnson | 84/637 |
| 6,111,179 | A * | 8/2000 | Miller | 84/442 |
| 7,161,080 | B1 * | 1/2007 | Barnett | 84/613 |
| 7,273,979 | B2 * | 9/2007 | Christensen | 84/615 |
| 7,394,013 | B2 | 7/2008 | Fallgatter | |
| 7,842,877 | B2 * | 11/2010 | Charles | 84/615 |
| 8,003,874 | B2 * | 8/2011 | Asakura et al. | 84/613 |
| 8,163,992 | B2 * | 4/2012 | Charles | 84/615 |
| 8,173,884 | B2 * | 5/2012 | Gatzsche et al. | 84/615 |
| 8,207,435 | B2 * | 6/2012 | Charles | 84/471 R |
| 2006/0123982 | A1 * | 6/2006 | Christensen | 84/723 |
| 2007/0240559 | A1 * | 10/2007 | Hasebe | 84/637 |
| 2010/0294112 | A1 * | 11/2010 | Asakura et al. | 84/613 |
| 2011/0030536 | A1 * | 2/2011 | Charles | 84/645 |
| 2011/0100198 | A1 * | 5/2011 | Gatzsche et al. | 84/615 |

FOREIGN PATENT DOCUMENTS

| | | |
|---|---|---|
| EP | 2 159 785 A2 | 3/2010 |
| EP | 2 159 785 A3 | 5/2010 |

* cited by examiner

*Primary Examiner* — Marlon Fletcher
(74) *Attorney, Agent, or Firm* — Kilpatrick Townsend & Stockton LLP

(57) ABSTRACT

A user interface for a virtual musical instrument presents a number of chord touch regions, each corresponding to a chord of a diatonic key. Within each chord region a number of touch zones are provided, including treble clef zones and bass clef zones. Each treble clef touch zone within a region will sound a different chord voicing. Each bass clef touch zone will sound a bass note of the chord. Other user interactions can modify or mute the chords, and vary the bass notes being played together with the chords. A set of related chords and/or a set of rhythmic patterns can be generated based on a selected instrument and a selected style of music.

36 Claims, 5 Drawing Sheets

INTELLIGENT KEYBOARD INTERFACE FOR VIRTUAL MUSICAL INSTRUMENT

FIELD

The disclosed technology relates generally to devices and methods for playing a virtual musical instrument such as a virtual keyboard.

BACKGROUND

Virtual musical instruments, such as MIDI-based or software-based keyboards, guitars, strings or horn ensembles and the like typically have user interfaces that simulate the actual instrument. For example, a virtual piano or organ will have an interface configured as a touch-sensitive representation of a keyboard; a virtual guitar will have an interface configured as a touch-sensitive fretboard. Such interfaces assume the user is a musician or understands how to play notes, chords, chord progressions etc., on a real musical instrument corresponding to the virtual musical instrument, such that the user is able to produce pleasing melodic or harmonic sounds from the virtual instrument. Such requirements create many problems.

First, not all users who would enjoy playing a virtual instrument are musicians who know how to form chords or construct pleasing chord progressions within a musical key. Second, users who do know how to form piano chords may find it difficult to play the chords on the user interfaces, because the interfaces lack tactile stimulus, which guides the user's hands on a real piano. For example, on a real piano a user can feel the cracks between the keys and the varying height of the keys, but on an electronic system, no such textures exist. These problems lead to frustration and make the systems less useful, less enjoyable, and less popular. Therefore, a need exists for a system that strikes a balance between simulating a traditional musical instrument and providing an optimized user interface that allows effective musical input and performance, and that allows even non-musicians to experience a musical performance on a virtual instrument.

SUMMARY

Various embodiments provide systems, methods, and devices for musical performance and/or musical input that solve or mitigate many of the problems of prior art systems. A user interface presents a number of chord touch regions, each corresponding to a chord of a diatonic key, such as a major or minor key. The chord touch regions are arranged in a predetermined sequence, such as by fifths within a particular key. Within each chord region a number of touch zones are provided, including treble clef zones and bass clef zones. Each treble clef touch zone within a region will sound a different chord voicing (e.g., root position, first inversion, second inversion, etc.) when selected by a user. Each bass clef touch zone will sound a bass note of the chord. Other user interactions can modify or mute the chords, and vary the bass notes being played together with the chords. A set of related chords and/or a set of rhythmic patterns can be generated based on a selected instrument and a selected style of music. Such a user interface allows a non-musician user to instantly play varying chords and chord voicings within a particular musical key, such that a pleasing musical sound can be obtained even without knowledge of music theory.

BRIEF DESCRIPTION OF THE DRAWINGS

In order to further explain describe various aspects, examples, and inventive embodiments, the following figures are provided.

Figure 1:
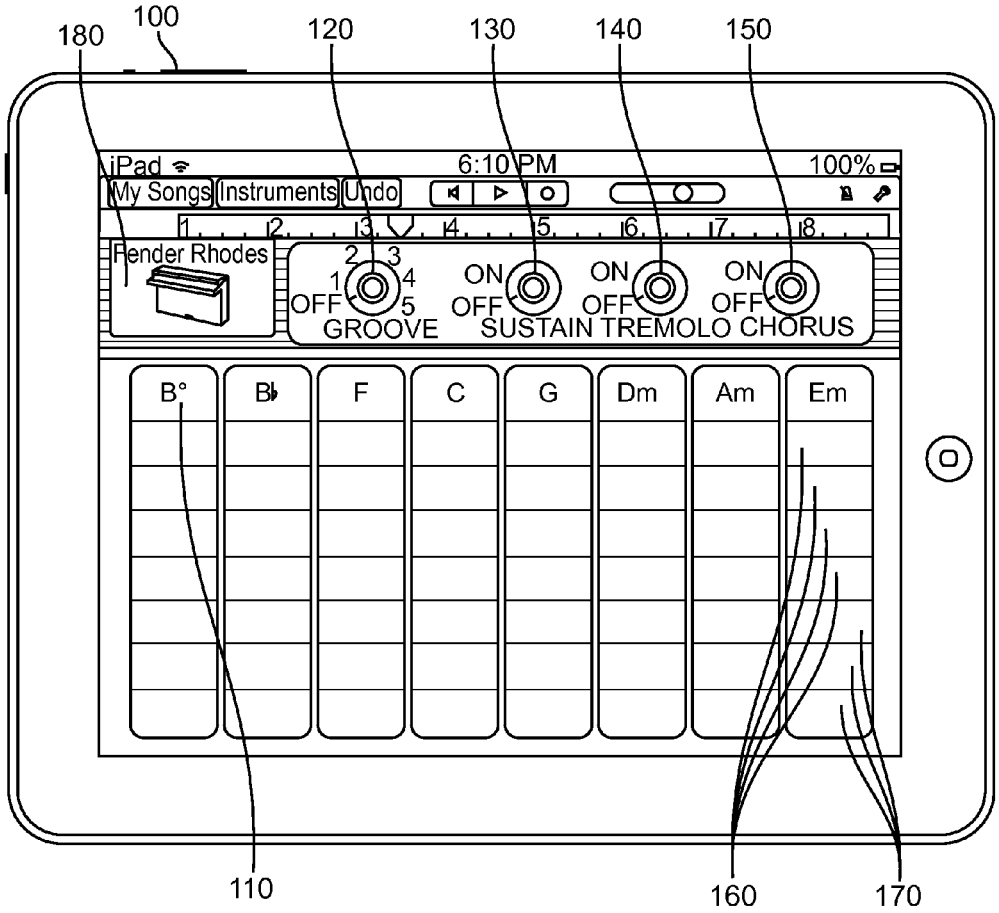
FIG. 1 depicts a schematic illustration of a user interface according to one aspect of the disclosed technology.

It should be understood that the various embodiments are not limited to the arrangements and instrumentality shown in the drawings.

DETAILED DESCRIPTION

The functions described as being performed by various components can be performed by other components, and the various components can be combined and/or separated. Other modifications can also be made.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure. Numerical ranges include all values within the range. For example, a range of from 1 to 10 supports, discloses, and includes the range of from 5 to 9. Similarly, a range of at least 10 supports, discloses, and includes the range of at least 15.

The following disclosure describes systems, methods, and products for musical performance and/or input. Various embodiments can include or communicatively couple with a wireless touchscreen device. A wireless touchscreen device including a processor can implement the methods of various embodiments. Many other examples and other characteristics will become apparent from the following description.

A musical performance system can accept user inputs and audibly sound one or more tones. User inputs can be accepted via a user interface. A musical performance system, therefore, bears similarities to a musical instrument. However, unlike most musical instruments, a musical performance system is not limited to one set of tones. For example, a classical guitar or a classical piano can sound only one set of tones, because a musician's interaction with the physical characteristics of the instrument produces the tones. On the other hand, a musical performance system can allow a user to modify one or more tones in a set of tones or to switch between multiple sets of tones. A musical performance system can allow a user to modify one or more tones in a set of tones by employing one or more effects units. A musical performance system can allow a user to switch between multiple sets of tones. Each set of tones can be associated with a channel strip (CST) file.

A CST file can be associated with a particular track. A CST file can contain one or more effects plugins, one or more settings, and/or one or more instrument plugins. The CST file can include a variety of effects. Types of effects include: reverb, delay, distortion, compressors, pitch-shifting, phaser, modulations, envelope filters, equalizers. Each effect can include various settings. Some embodiments provide a mechanism for mapping two stompbox bypass controls in the channel strip (.cst) file to the interface. Stompbox bypass controls will be described in greater detail hereinafter. The CST file can include a variety of settings. For example, the settings can include volume and pan. The CST file can include a variety of instrument plugins. An instrument plugin can generate one or more sounds. For example, an instrument plugin can be a sampler, providing recordings of any number of musical instruments, such as recordings of a guitar, a piano, and/or a tuba. Therefore, the CST file can be a data object capable of generating one or more effects and/or one or more sounds. The CST file can include a sound generator, an effects generator, and/or one or more settings.

A musical performance method can include accepting user inputs via a user interface, audibly sounding one or more tones, accepting a user request to modify one or more tones in a set of tones, and/or accepting a user request to switch between multiple sets of tones.

A musical performance product can include a computer-readable medium and a computer-readable code stored on the computer-readable medium for causing a computer to perform a method that includes accepting user inputs, audibly sounding one or more tones, accepting a user request to modify one or more tones in a set of tones, and/or accepting a user request to switch between multiple sets of tones.

A non-transitory computer readable medium for musical performance can include a computer-readable code stored thereon for causing a computer to perform a method that includes accepting user inputs, audibly sounding one or more tones, accepting a user request to modify one or more tones in a set of tones, and/or accepting a user request to switch between multiple sets of tones.

A musical input system can accept user inputs and translate the inputs into a form that can be stored, recorded, or otherwise saved. User inputs can include elements of a performance and/or selections on one or more effects units. A performance can include the playing of one or more notes simultaneously or in sequence. A performance can also include the duration of one or more played notes, the timing between a plurality of played notes, changes in the volume of one or more played notes, and/or changes in the pitch of one or more played notes, such as bending or sliding.

A musical input system can include or can communicatively couple with a recording system, a playback system, and/or an editing system. A recording system can store, record, or otherwise save user inputs. A playback system can play, read, translate, or decode live user inputs and/or stored, recorded, or saved user inputs. When the playback system audibly sounds one or more live user inputs, it functions effectively as a musical performance device, as previously described. A playback system can communicate with one or more audio output devices, such as speakers, to sound a live or saved input from the musical input system. An editing system can manipulate, rearrange, enhance, or otherwise edit the stored, recorded, or saved inputs.

Again, the recording system, the playback system, and/or the editing system can be separate from or incorporated into the musical input system. For example, a musical input device can include electronic components and/or software as the playback system and/or the editing system. A musical input device can also communicatively couple to an external playback system and/or editing system, for example, a personal computer equipped with playback and/or editing software. Communicative coupling can occur wirelessly or via a wire, such as a USB cable.

A musical input method can include accepting user inputs, translating user inputs into a form that can be stored, recorded, or otherwise saved, storing, recording, or otherwise saving user inputs, playing, reading, translating, or decoding accepted user inputs and/or stored, recorded, or saved user inputs, and manipulating, rearranging, enhancing, or otherwise editing stored, recorded, or saved inputs.

A musical input product can include a computer-readable medium and a computer-readable code stored on the computer-readable medium for causing a computer to perform a method that includes accepting user inputs, translating user inputs into a form that can be stored, recorded, or otherwise saved, storing, recording, or otherwise saving user inputs, playing, reading, translating, or decoding accepted user inputs and/or stored, recorded, or saved user inputs, and manipulating, rearranging, enhancing, or otherwise editing stored, recorded, or saved inputs.

A non-transitory computer readable medium for musical input can include a computer-readable code stored thereon for causing a computer to perform a method that includes accepting user inputs, translating user inputs into a form that can be stored, recorded, or otherwise saved, storing, recording, or otherwise saving user inputs, playing, reading, translating, or decoding accepted user inputs and/or stored, recorded, or saved user inputs, and manipulating, rearranging, enhancing, or otherwise editing stored, recorded, or saved inputs.

Accepting user inputs is important for musical performance and for musical input. User inputs can specify which note or notes the user desires to perform or to input. User inputs can also determine the configuration of one or more features relevant to musical performance and/or musical input. User inputs can be accepted by one or more user interface configurations.

Musical performance system embodiments and/or musical input system embodiments can accept user inputs. Systems can provide one or more user interface configurations to accept one or more user inputs.

Musical performance method embodiments and/or musical input method embodiments can include accepting user inputs. Methods can include providing one or more user interface configurations to accept one or more user inputs.

Musical performance product embodiments and/or musical input product embodiments can include a computer-readable medium and a computer-readable code stored on the computer-readable medium for causing a computer to perform a method that includes accepting user inputs. The method can also include providing one or more user interface configurations to accept one or more user inputs.

A non-transitory computer readable medium for musical performance and/or musical input can include a computer-readable code stored thereon for causing a computer to perform a method that includes accepting user inputs. The method can also include providing one or more user interface configurations to accept one or more user inputs.

The one or more user interface configurations, described with regard to system, method, product, and non-transitory computer-readable medium embodiments, can include a chord view and a notes view.

FIG. 1 shows a schematic illustration of an intelligent user interface 100 for a virtual musical instrument. FIG. 1 shows the user interface displayed on a tablet computer such as the Apple iPad®; however the interface could be used on any touchscreen or touch-sensitive computing device. The interface 100 includes a rig or sound browser button 180, which is used to select the virtual instrument (e.g., acoustic piano, electric piano, electronic organ, pipe organ, etc.) desired by the user. When a user selects an instrument with the rig browser 180, the system will load the appropriate CST file for that instrument.

The interface 100 includes a number of chord touch regions 110, shown for example as a set of eight adjacent columns or strips. Each touch region corresponds to a pre-defined chord within one or particular keys, with adjacent regions configured to correspond to different chords and progressions within the key or keys. For example, the key of C major includes the chords of C major (I), D minor (ii), E minor (iii), F major (IV), G major (V), A minor (vi), and B diminished (vii), otherwise known as the Tonic, Supertonic, Mediant, Subdominant, Dominant, Submediant, and Leading Tone. In the example shown in FIG. 1, an additional chord of B-flat major is included for the key of C major. In the example shown in FIG. 1, the chords are arranged sequentially according to the circle of fifths. This arrangement allows a user to create sonically pleasing sequences by exploring adjacent touch regions.

Each chord touch region is divided into a number of touch zones 160 and 170. Zones 160 correspond to various chord voicings of the same chord in the treble clef (right hand), and zones 170 correspond to different bass note chord elements in the bass clef (left hand). In the example shown in FIG. 1, there are five zones 160 for the treble clef and three zones 170 for the bass clef. Each touch zone 160 in the treble clef corresponds to a different voicing of the same chord of the region 110. For example, the lowermost zone 160 of the C major region could correspond to the root position of the C major chord, or the triad notes C-E-G played with the C note being the lowest tone in the triad. The adjacent zone 160 could correspond to the first inversion of the C major chord, or the notes E-G-C with the E note being the lowest tone; the next higher zone 160 could correspond to the second inversion of the C major chord, or the notes G-C-E with the G note being the lowest tone, etc. Swiping up or down through the zones 160 causes the chord voicing to change by the minimum number of notes needed to switch to the nearest inversion from the chord voicing that was being played prior to the finger swipe motion.

The lower three zones 170 correspond to bass clef voicings, and may be for example root-five-octave sets, or root notes in different octaves. For example, the lower three zones 170 in the C major region could correspond to the notes C-G-C respectively, or the notes C-C-C in different octaves.

The chords and bass notes assigned to each touch zone 160, 170 can be small MIDI files. MIDI (Musical Instrument Digital Interface) is an industry-standard protocol defined in 1982 that enables electronic musical instruments such as keyboard controllers, computers, and other electronic equipment to communicate, control, and synchronize with each other. Touching any zone 160 in a region 110 plays the chord MIDI file assigned to that zone, while touching any zone 170 in a region 110 plays the bass note MIDI file assigned that zone. Only one touch zone can be active for a treble clef zone and only one touch zone can be active for a bass clef zone at any time.

The interface 110 also includes various auto-play/effects knobs. A groove knob 120 is used to select one of a number of predefined tempo-locked rhythms that will loop a MIDI file. When the user selects one of the auto-play options of the groove knob, the assigned rhythm will play for the corresponding chord of the zone 160 when it is first touched by the user. The groove rhythm will latch, meaning that the rhythm will stop when the user touches the same chord zone again. The groove rhythm will switch to a new chord when a different chord is selected by the user touching another zone. Each auto-play groove will include a treble (right hand) and bass (left hand) part. A touch zone at the top of the chord regions or strips 110 where the name of the chord is displayed will trigger the playing of default treble and bass parts for the selected chord. Touching a treble zone will trigger only the treble part of the groove rhythm and similarly touching a bass zone will trigger only the bass part of the groove rhythm. Additionally, effects such as tremolo and chorus may be turned on or off by the user selecting positions of tremolo and chorus knobs 140 and 150. Sustain knob 130 simulates a sustain pedal on an instrument. Notes for the chord player will sustain as long as a zone is being touched, just like a standard MIDI keyboard unless they are modified with the sustain pedal. When on, the sustain command will remain active until the chord being played is changed. So long as user input is within the same region, the sustain effect will remain locked on. When the chord is changed, the sustain effect will be cleared, and then restarted.

FIGS. 2A-2F illustrate examples of possible sequences of user actions on the intelligent interface. A user could play a lower region zone from one chord while playing an upper region zone from another chord, effectively allowing diatonic slash chords to be played. A user could also play upper regions from different chords at the same time, effectively building diatonic poly-chords. For instance, playing an A minor chord with a C Major chord will yield an A minor $7^{th}$ chord. Or, playing a G Major chord with a B diminished chord will create a G Major $7^{th}$ chord.

Figure 2B:
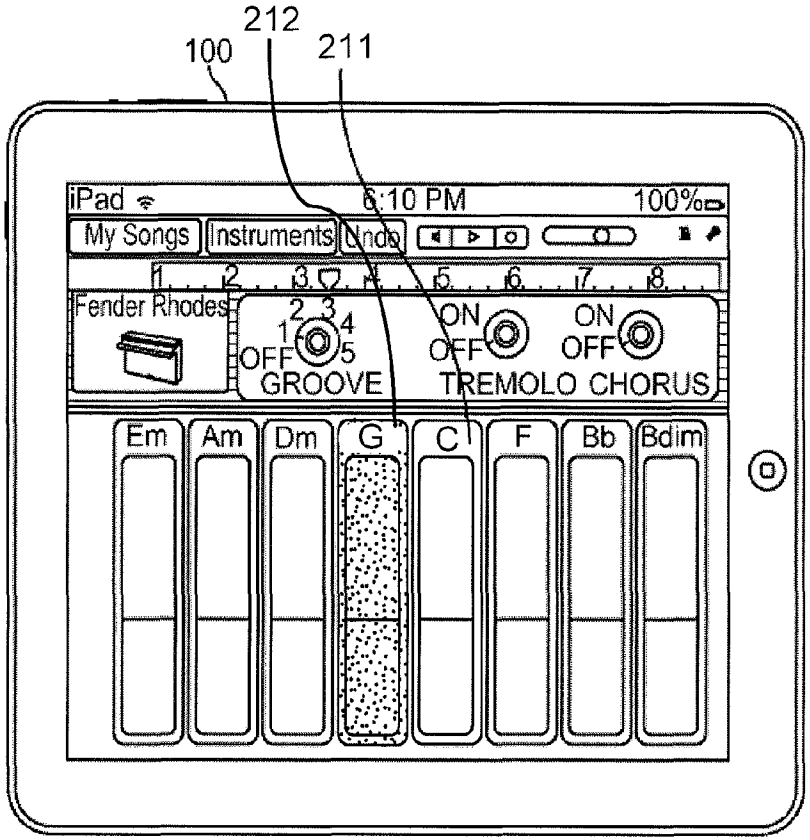
FIGS. 2A-2F depict schematic illustrations of a possible playing sequence by a user in accordance with an aspect of the disclosed technology.
Figure 2A:
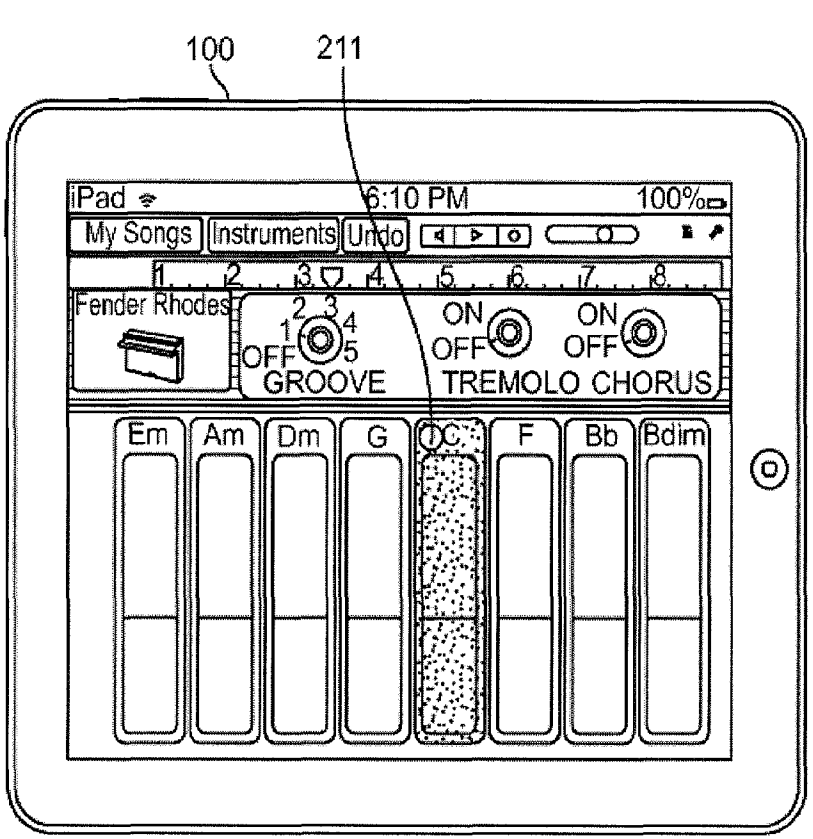

As shown in FIG. 2A, when a user taps or touches a top zone 211 in the C Major region, the upper (treble clef) and lower (bass clef) parts of the selected groove rhythm are played. In FIG. 2B, the user then touches or taps top zone 212 in the G Major region. This causes the selected groove rhythm to switch to the G Major chord. Next, as shown in FIG. 2C, the user taps or touches the lower (bass clef) zone 213 in the C Major region. This causes the selected groove rhythm to switch to the bass clef part of the C Major region, while continuing to play the groove rhythm of the upper (treble clef) G Major chord.

Figure 2D:
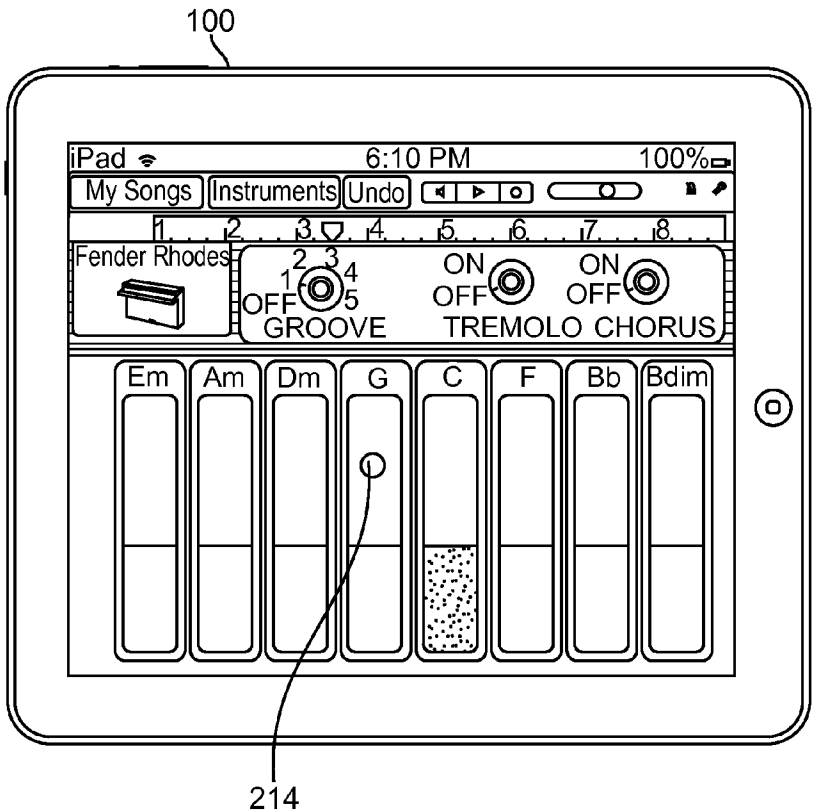
Figure 2C:
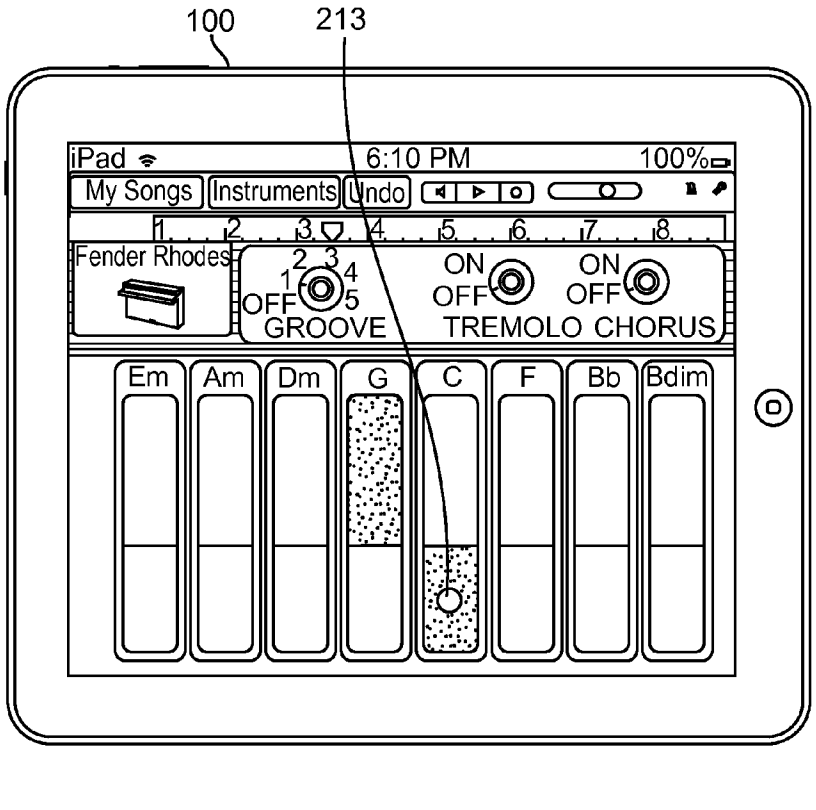
Figure 2F:
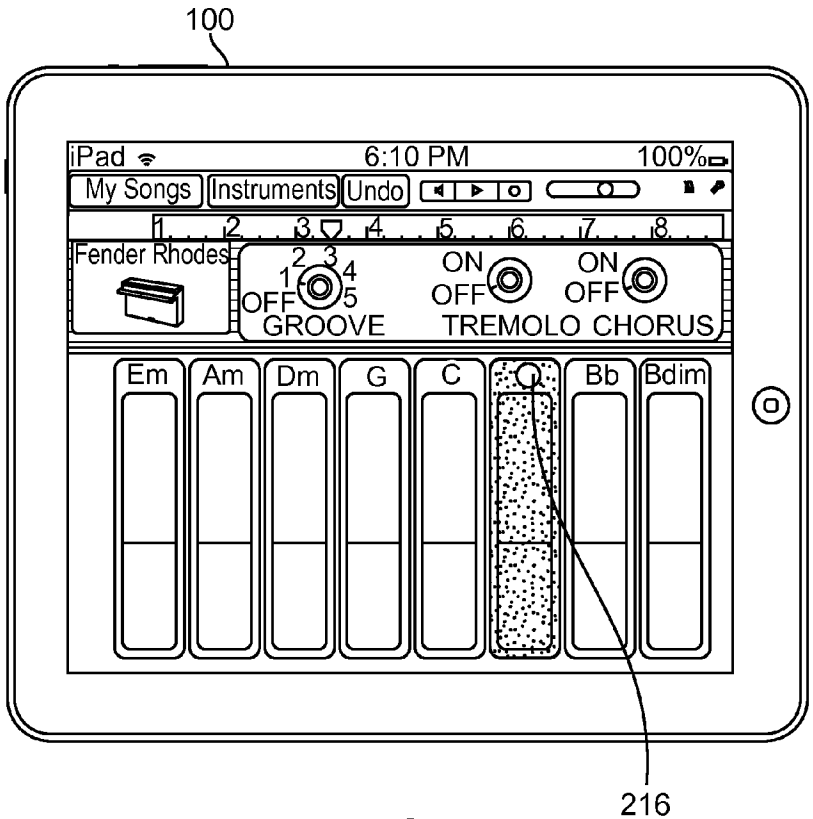
Figure 2E:
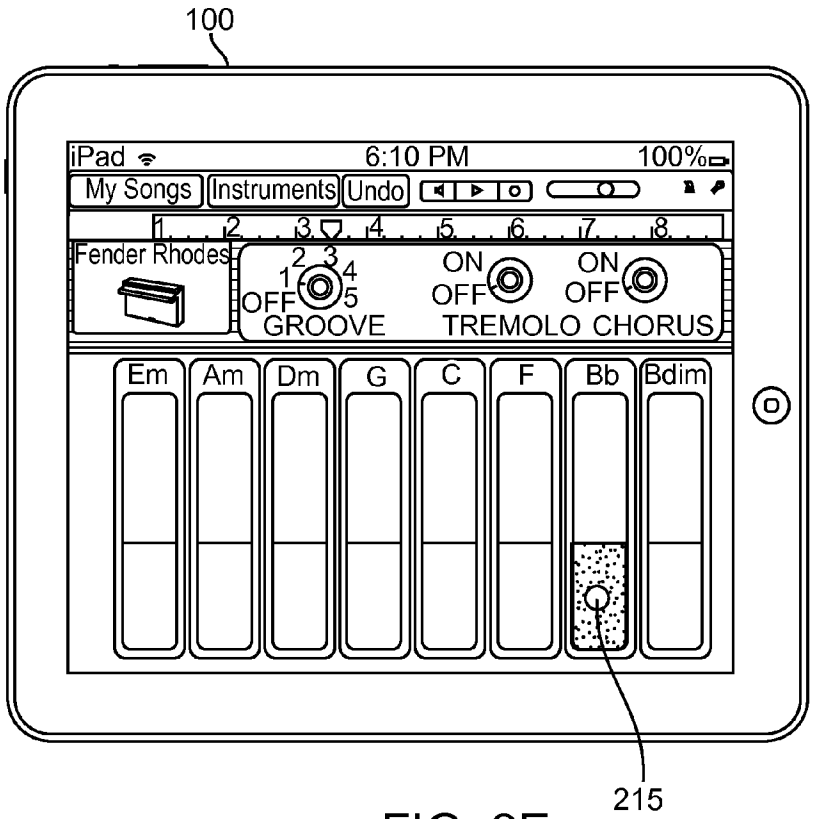

Next in the exemplary sequence of play, as shown in FIG. 2D, the user would tap or touch upper (treble clef) zone 214 in the G Major region. This would cause the treble G Major groove rhythm to stop playing, while the lower (bass clef) C Major groove rhythm would continue to play. In FIG. 2E, the user touches or taps the lower (bass clef) zone 215 in the Bb Major region. This causes the lower (bass clef) groove rhythm to switch to the Bb Major notes, while the upper (treble clef) would remain off. Finally, in FIG. 2F the user touches or taps the top zone 216 in the F Major region. This causes the upper (treble clef) and lower (bass clef) groove rhythms to play using the G Major triad notes and bass notes associated with the G Major region.

Figure 3:
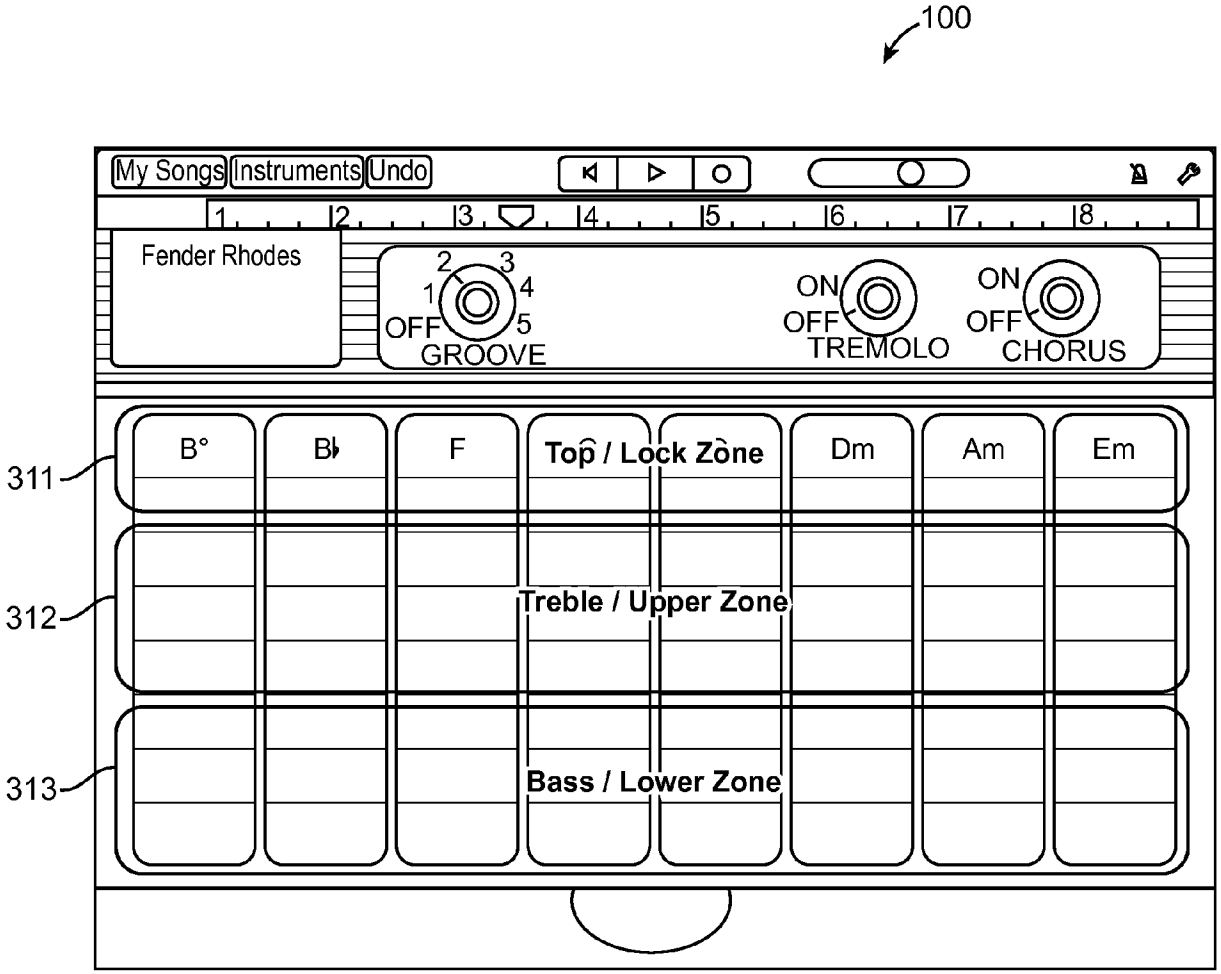
FIG. 3 depicts a schematic illustration of an auto-play mode of the user interface in accordance with another aspect of the disclosed technology.

FIG. 3 illustrates an auto-play mode of the intelligent interface. When the groove knob is set to a state other than "off," the zone divider lines of the upper and lower touch zones in each region will become faded, indicating that the individual touch zones are inactive. Instead, the chord regions will have three touch positions: a Top/Lock zone position 311, an Upper/Treble zone position 312, and a Lower/Bass zone position 313.

When a user taps or touches the Top/Lock position 311, the selected groove rhythm will be started for both the upper (treble clef) and lower (bass clef) parts in the selected chord. If the same position 311 is touched again, the upper and lower groove rhythms will be stopped.

If a user taps or touches a Lower/Bass zone position 313 within a chord region, the groove rhythm of the lower (bass clef) part will switch to that chord independently of the chord playing in the upper (treble clef) part. Similarly, if a user taps or touches an Upper/Treble zone position 312 within a chord region, the groove rhythm of the upper (treble clef) part will switch to that chord independently of the chord playing in the lower (bass clef) part. If a user taps or touches the Top/Lock position 311 when different upper and lower groove rhythm regions are playing, then both the upper and lower parts will switch to the new chord region.

As stated above, swiping vertically within a chord region will cause the chords in the different zones to be played without requiring a new tap. Common tones between the different chord inversions will not be re-triggered when approached by a swipe, but only new non-common tones will be triggered by the swipe, while common tones will continue to play. Moving in a horizontal swipe motion after a chord has been triggered will cause an effect to be triggered. Examples could be Mod Wheel effects, wah-wah, etc. The intelligent interface also will respond to velocity via the accelerometer.

Touching a zone with two fingers will play an alternate version of the groove MIDI file. If two fingers touch inside any of the zones in a chord region an alternate version of the groove is played. Typically this would involve harmonic changes to the groove, for instance changing to a suspended version of the chord or adding extensions (i.e., sixths, sevenths, ninths etc.). When the second touch is added to a single touch of the chord, the groove will switch to the alternate version. When the second touch is removed from the region but one touch remains active, the groove will switch back to the standard version of the groove. If both fingers are removed simultaneously or within a small time delta of each other, the alternate version of the groove will latch.

When switching to a new chord, a two finger tap will be required to trigger the alternate version of the groove for the new chord. In other words, if the user triggered the alternate groove with a two finger tap on the Top/Lock zone for C Major, then moved to F Major with a single finger tap on the Top/Lock zone for F Major, the F Major groove would be the standard F groove, not the alternate groove, until a two finger touch was detected. Two finger touches must occur within the same chord region to trigger an alternate groove.

The above disclosure provides examples and aspects relating to various embodiments within the scope of claims, appended hereto or later added in accordance with applicable law. However, these examples are not limiting as to how any disclosed aspect may be implemented, as those of ordinary skill can apply these disclosures to particular situations in a variety of ways.

All the features disclosed in this specification (including any accompanying claims, abstract, and drawings) can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, sixth paragraph. In particular, the use of "step of" in the claims herein is not intended to invoke the provisions of 35 U.S.C. §112, sixth paragraph.

What is claimed is:

1. A user interface implemented on a touch-sensitive display for a virtual musical instrument, comprising:

a plurality of chord touch regions configured in a predetermined sequence, wherein a chord touch region corresponds to a chord in a musical key, wherein a chord touch region is divided into a number of separate touch zones, wherein touch zones include a treble clef zone corresponding to treble clef notes assigned to a chord touch region, and a bass clef zone corresponding to bass clef notes assigned to a chord touch region, and wherein the plurality of chord touch regions define a predetermined set of chords; and wherein at least two touch zones are associated with preselected MIDI files stored in a computer-readable medium, whereby touching of a touch zone causes a corresponding MIDI file to be played on an output device.

2. The user interface of claim 1, wherein the predetermined set of chords comprise seven diatonic chords of a musical key.

3. The user interface of claim 1, further comprising a touch-sensitive groove selector allowing a user to select one of a plurality of grooves, wherein each groove comprises a rhythmic pattern of tones associated with a style of music, and wherein selection of a groove using the groove selector causes chord and bass note sets selected by touching the touch zones to be played according to the rhythmic pattern.

4. The user interface of claim 3, wherein each groove is a MIDI pattern stored in a MIDI file.

5. The user interface of claim 1, further comprising a top/lock touch zone for at least one chord touch region, whereby touching of the top/lock zone causes treble clef notes and bass clef notes associated with at least one chord touch region to be played simultaneously.

6. The user interface of claim 1, wherein a user swipe motion across a treble clef zones in a chord touch region causes different chord inversion voicings to be played.

7. The user interface of claim 1, wherein a user swipe motion across a bass clef zones in a chord touch region causes different bass notes to be played.

8. The user interface of claim 1, wherein a treble clef chord in a first chord touch region may be played simultaneously with a bass clef note in a second chord touch region in response to a user tapping touch zones in different chord touch regions in a sequence.

9. The user interface of claim 1, wherein a treble clef chord in a first chord touch region and a treble clef chord in a second chord touch region may be played simultaneously in response to a user tapping touch zones in different chord touch regions in a sequence.

10. The user interface of claim 1, wherein in response to detection of a two finger touch within a touch zone, an alternate groove rhythm is played for the chord corresponding to the chord touch region in which the touch zone is located.

11. The user interface of claim 10, wherein the alternative groove rhythm includes an extended version of chord.

12. The user interface of claim 10, wherein the alternative groove rhythm includes a suspended version of the chord.

13. A computer program product stored on a non-transitory computer-readable storage medium, comprising computer-executable instructions causing a processor to:

in response to input from a user interface implemented on a touch-sensitive display for a virtual musical instrument, comprising a plurality of chord touch regions configured in a predetermined sequence, wherein a chord touch region corresponds to a chord in a musical key, wherein a chord touch region is divided into a number of separate touch zones, wherein touch zones include a treble clef zone corresponding to treble clef notes assigned to a chord touch region, and a bass clef zone corresponding to bass clef notes assigned to a chord touch region, and wherein the plurality of chord touch regions define a predetermined set of chords, cause a preselected MIDI file to be played on an output device wherein said input from a user comprises a touching of at least one touch zone associated with said preselected MIDI file stored in a computer-readable medium.

14. The computer-program product of claim 13, wherein the predetermined set of chords comprise seven diatonic chords of a musical key.

15. The computer-program product of claim 13, further comprising a touch-sensitive groove selector allowing a user to select one of a plurality of grooves, wherein each groove comprises a rhythmic pattern of tones associated with a style of music, and wherein selection of a groove using the groove selector causes chord and bass note sets selected by touching the touch zones to be played according to the rhythmic pattern.

16. The computer-program product of claim 15, wherein each groove is a MIDI pattern stored in a MIDI file.

17. The computer-program product of claim 13, further comprising a top/lock touch zone for at least one chord touch region, whereby touching of the top/lock zone causes treble clef notes and bass clef notes associated with at least one chord touch region to be played simultaneously.

18. The computer-program product of claim 13, wherein a user swipe motion across a treble clef zones in a chord touch region causes different chord inversion voicings to be played.

19. The computer-program product of claim 13, wherein a user swipe motion across a bass clef zones in a chord touch region causes different bass notes to be played.

20. The computer-program product of claim 13, wherein a treble clef chord in a first chord touch region may be played simultaneously with a bass clef note in a second chord touch region in response to a user tapping touch zones in different chord touch regions in a sequence.

21. The computer-program product of claim 13, wherein a treble clef chord in a first chord touch region and a treble clef chord in a second chord touch region may be played simultaneously in response to a user tapping touch zones in different chord touch regions in a sequence.

22. The computer-program product of claim 13, wherein in response to detection of a two finger touch within a touch zone, an alternate groove rhythm is played for the chord corresponding to the chord touch region in which the touch zone is located.

23. The computer-program product of claim 22, wherein the alternative groove rhythm includes an extended version of chord.

24. The computer-program product of claim 22, wherein the alternative groove rhythm includes a suspended version of the chord.

25. A computer-implemented method, comprising:

in response to input from a user interface implemented on a touch-sensitive display for a virtual musical instrument, comprising a plurality of chord touch regions configured in a predetermined sequence, wherein a chord touch region corresponds to a chord in a musical key, wherein a chord touch region is divided into a number of separate touch zones, wherein touch zones include a treble clef zone corresponding to treble clef notes assigned to a chord touch region, and a bass clef zone corresponding to bass clef notes assigned to a chord touch region, and wherein the plurality of chord touch regions define a predetermined set of chords, causing a preselected MIDI file to be played on an output device wherein said input from a user comprises a touching of at least one touch zone associated with said preselected MIDI file stored in a computer-readable medium.

26. The method of claim 25, wherein the predetermined set of chords comprise seven diatonic chords of a musical key.

27. The method of claim 25, further comprising a touch-sensitive groove selector allowing a user to select one of a plurality of grooves, wherein each groove comprises a rhythmic pattern of tones associated with a style of music, and wherein selection of a groove using the groove selector causes chord and bass note sets selected by touching the touch zones to be played according to the rhythmic pattern.

28. The method of claim 27, wherein each groove is a MIDI pattern stored in a MIDI file.

29. The method of claim 25, further comprising a top/lock touch zone for at least one chord touch region, whereby touching of the top/lock zone causes treble clef notes and bass clef notes associated with at least one chord touch region to be played simultaneously.

30. The method of claim 25, wherein a user swipe motion across a treble clef zones in a chord touch region causes different chord inversion voicings to be played.

31. The method of claim 25, wherein a user swipe motion across a bass clef zones in a chord touch region causes different bass notes to be played.

32. The method of claim 25, wherein a treble clef chord in a first chord touch region may be played simultaneously with a bass clef note in a second chord touch region in response to a user tapping touch zones in different chord touch regions in a sequence.

33. The method of claim 25, wherein a treble clef chord in a first chord touch region and a treble clef chord in a second chord touch region may be played simultaneously in response to a user tapping touch zones in different chord touch regions in a sequence.

34. The method of claim 25, wherein in response to detection of a two finger touch within a touch zone, an alternate groove rhythm is played for the chord corresponding to the chord touch region in which the touch zone is located.

35. The method of claim 34, wherein the alternative groove rhythm includes an extended version of chord.

36. The method of claim 34, wherein the alternative groove rhythm includes a suspended version of the chord.

* * * * *